US006280364B1

(12) United States Patent
Deac et al.

(10) Patent No.: US 6,280,364 B1
(45) **Date of Patent: *Aug. 28, 2001**

(54) METHOD FOR EXERCISING

(76) Inventors: Titus Deac; Joanna Deac, both of 674 de la Metairie, Nuns Island, Verdun, Quebec (CA), H3E 1T1; Charles Kwesi Collisson, 7017 Sherbrooke Street West, Apt. 7, Montreal, Quebec (CA), H4B 1R4; Alina Michelle Collisson, 937 Clifton Avenue, Montreal, Quebec (CA), H4A 2N1

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/275,967

(22) Filed: Mar. 25, 1999

Related U.S. Application Data

(63) Continuation of application No. 08/864,368, filed on May 28, 1997, now Pat. No. 5,891,003.

(51) Int. Cl.[7] ..... A63B 21/65
(52) U.S. Cl. ..... 482/106; 482/110; 482/92
(58) Field of Search ..... 482/92, 104, 105, 482/106, 107, 110, 33, 34, 121, 148, 908; 446/486

(56) References Cited

U.S. PATENT DOCUMENTS

| | | | | |
|---|---|---|---|---|
| 405,128 | * | 6/1889 | Stockburger | 482/106 |
| 3,679,107 | * | 7/1972 | Perrine . | |
| 4,832,334 | * | 5/1989 | Mullen . | |
| 5,147,262 | * | 9/1992 | Hymanson | 482/110 |
| 5,180,349 | * | 1/1993 | Marcus | 482/34 |
| 5,342,272 | * | 8/1994 | Pittroff | 482/106 |
| 5,393,284 | * | 2/1995 | Wesley | 482/106 |
| 5,891,003 | * | 4/1999 | Deac | 482/106 |

OTHER PUBLICATIONS

Strength & Power in Sports, Blackwell Scientific Publicat. 1992.*

Muscle & Fitness Magazine (Photos From 1966–1968), pp 96, 117, Jul. 1997.*

Body Builder Discount Outlet Catalogue, p. 31, 1994.*

* cited by examiner

*Primary Examiner*—Jerome W. Donnelly
(74) *Attorney, Agent, or Firm*—Swabey Ogilvy Renault

(57) ABSTRACT

A method for exercising the lower body of a person comprising an elongated spring bar which may or may not be provided with weights at the ends. A protective collar is provided centrally of the bar to permit the user to support the bar on the shoulders or on the back. The user springs up and down between an erected and squat position and the bar oscillates in a manner such that as the user is moving downwardly towards the squat position the bar forms a tension arc with the ends pointing upwardly and after the user has reached the lower most position and is beginning his upward movement, the arc will form a tension arc with the ends pointing downwardly, and as the user reaches his erect position the bar will enhance a further upward movement as the tension is released.

15 Claims, 8 Drawing Sheets

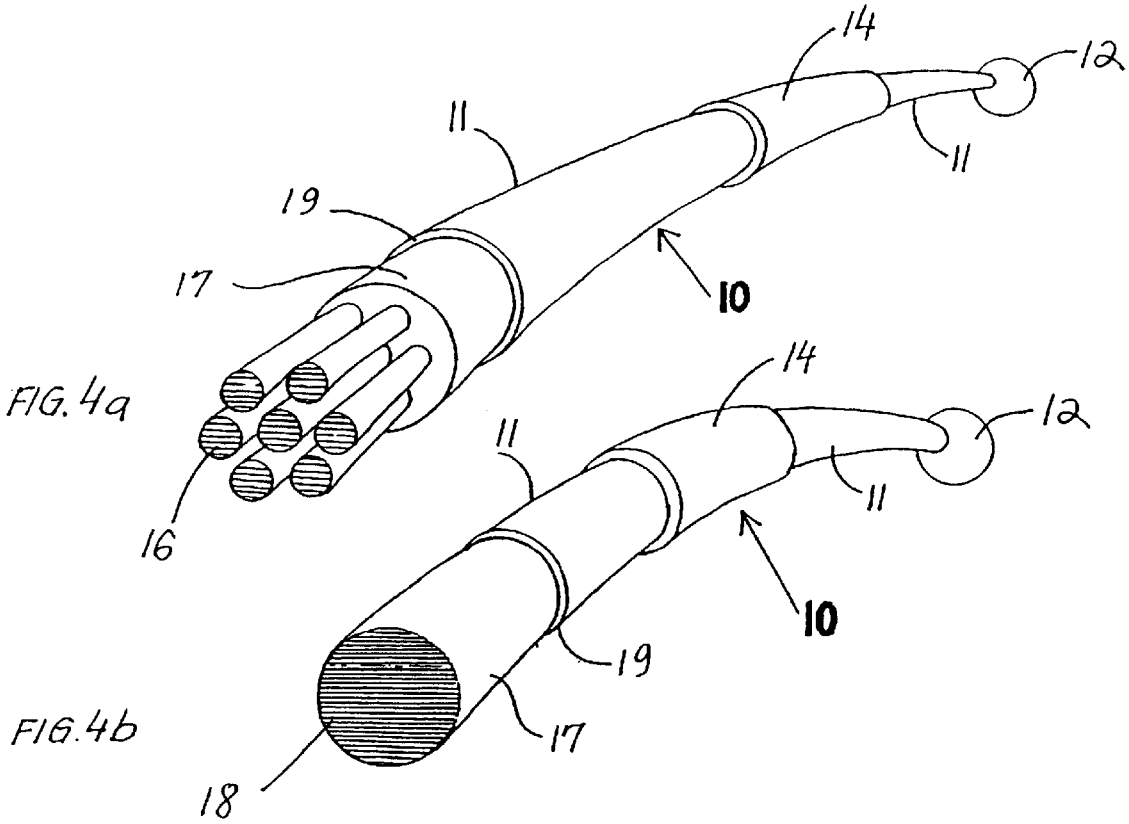
FIG. 4a
FIG. 4b
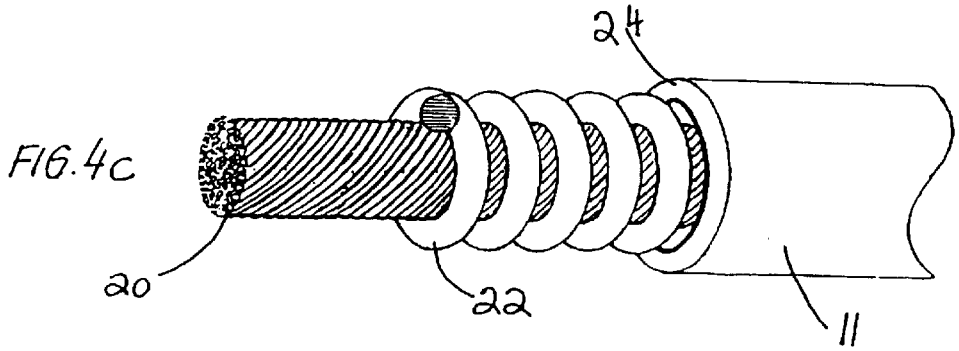
FIG. 4c
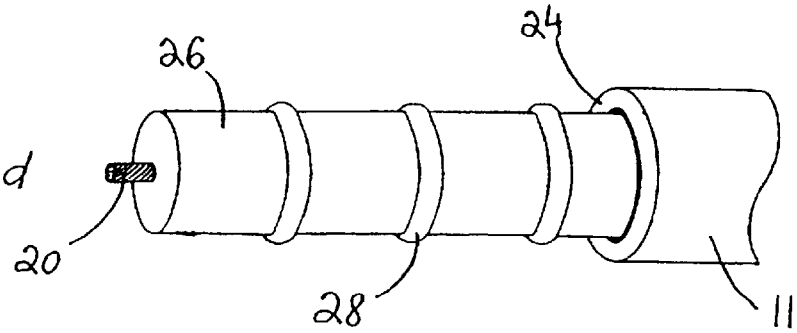
FIG. 4d

METHOD FOR EXERCISING

CROSS REFERENCE TO RELATED APPLICATION

This application is a continuation application of U.S. application Ser. No. 08/864,368, filed May 28, 1997 U.S. Pat. No. 5,891,003.

BACKGROUND OF THE INVENTION

1. Field of the Invention

The present invention relates to a method of exercising, and more particularly, with an exercise device for weight training for the purpose of developing lower body muscles and tendons and general body conditioning.

2. Description of the Prior Art

It is common in athletes to work out with weights as a means of developing the levels of strength needed in competitions. In lifting rigid weights, however, due to gravity, the velocity is generally inversely proportional with the load, that is the higher the load the lower the velocity and vice-versa. For this reason the value of lifting rigid weights as a means of muscle conditioning is less useful for certain athletic activities for which a fast, explosive type muscular power is required. On the other hand, simulating in training both the high load and the high velocity typical for competitions is desired. In this respect, for propulsion-type athletic activities like jumping and sprint running it would be advantageous if a direct relationship between the load and the velocity could be achieved so that higher speed levels characteristic for competitions could be attained when training with weights.

Based on various criteria, the literature describes different types of muscular contractions associated with the development of strength: isotonic, isometric, isokinetic, with variable resistance, plyometric etc. Insufficiently differentiated are the muscular contractions associated with decelerating and accelerating body movements, although their succession is common in running and jumping as well as in other activities.

For the purpose of this invention, the muscular activity associated with an acceleration movement is described as an "expometric" contraction, and that associated with a deceleration movement is described as an "expotonic" contraction.

For the purpose of the specification and claims the term "expotonic" refers to the muscular contractions that occur in decelerated movements and the initiation of new movements (cycles) such as flexing a member before an impulsion. An example could be the support phase in sprint running when the body inertia acts as a compounding factor in tensioning the flexing leg's muscles and tendons. In "expotonic" type muscular contractions the kinetic energy is transformed in potential energy and stored in the participating muscles and tendons.

The term "expometric" refers to muscular contractions associated with the fast release of a flexed member when a portion of the potential energy is transformed back into kinetic energy. This type of muscular activity is present in the impulsion phase of sprint running, characterized by the accelerated extension of the supporting leg. The impulsion is enhanced by the powerful eccentric work by arms and the oscillating leg, which further accelerate the motion of the entire body, facilitating the take-off.

SUMMARY OF THE INVENTION

We found that certain disadvantages in weight lifting may be overcome by using essentially flexible bars or other flexible spring bodies, capable of oscillating and, thus, of being actively bent into a succession of tensioned arcs having spring energy. The arc tension will depend on the load, the spring characteristics of the body (length, section, stiffness coefficient etc.) and the person's active movements. If weights are added to the free ends of the bar, they will also influence the tension and the oscillations of the spring body as well as the momentum of its free ends.

We have determined that working out with weights for producing enhanced "expotonic" and "expometric" muscular contractions could be achieved by using an exercise device provided with a flexible bar that can oscillate downwardly and upwardly, in phase with the person's movements, such that the bar's oscillations increase the downward pressure on the person and accelerate the person's upward motion.

More specifically, the present invention relates to a method of using an exercise device for working out with weights, operable by a person for the purpose of exercising the lower body muscles and general body conditioning, wherein the exercise device consists primarily of an essentially flexible bar or other elongated flexible spring body secured in its central segment, preferably on the shoulders or the back of the person, such that the spring body can oscillate freely in opposite directions in a mode synchronized with the person's movements.

The spring force created upon the bar being bent downwards into a tensioned arc causes the free ends to swing upwards, varying the load pressure on the person and creating a synergic force that could be used to enhance and accelerate the person's lifting motion and to turn it into a propulsion-type motion.

The ability of the spring body to oscillate makes it possible for the forces stored in the tensioned arced bar to change direction with each new oscillation, such that after a downward oriented momentum of the free ends, used to maximize both the potential energy of the spring body and the tension of the participating muscles, an upward oriented momentum could be attained, synergic with the person's weight-lifting motion.

The upward oriented momentum may cause the free ends to continue their upward swing above the straight linear position of the spring body, creating a new tensioned arc, bent upwards, and the new spring energy could cause the spring body's middle point to swing upwards, lifting rather than being lifted by the person, thus further accelerating the person's upward motion.

We found that by combining the force exerted by the person to lift a weight (the external force) with the force of a tensioned arc (the inner force), in certain conditions a direct rather than inverse relationship between the load and the velocity of the movement could be achieved, such that even at higher loads, higher level of velocity, typical for competitions, could be attained. The use of spring bars allows for an impulsion-type motion, common in lifting rigid barbells, to turn into a fast, accelerated, propulsion-type lift-off motion.

The property of being flexible also makes it possible to measure the bar's strain, allowing for load and speed planning and instant measurement.

Various types of motions (long jump, high jump, sprint running, endurance running, etc.) will require different amplitudes, curves, speeds and frequencies of the spring bar oscillations. These can be achieved by using materials of various compositions and elasticity characteristics (steels, alloys and other flexible metals in monofilament or multifilament bars, bundles, cables or coil springs, plastics, PVC, fiberglass, carbon, rubber, bamboo, laminated wood, etc.) as well as combinations of lengths, sections, weights, structures, shapes and forms.

The present method of strength development is applicable in those athletic activities where an explosive power typical for enhanced expotonic and expometric muscular contractions is required: sprint running, jumping, shotput and throwings, gymnastics, basketball, volleyball, baseball, football, hockey, etc.

Both expometric and expotonic contractions also have large applicability in home fitness, school physical education and muscle rehabilitation.

BRIEF DESCRIPTION OF THE DRAWINGS

Having thus generally described the nature of the invention, reference will now be made to the accompanying drawings showing, by way of illustration, a preferred embodiment thereof, and in which:

FIGS. 4*a* through 4*d* are perspective and fragmentary views partly in section of different embodiments of the spring bar of the present invention;

DESCRIPTION OF THE PREFERRED EMBODIMENTS

Figure 1A:
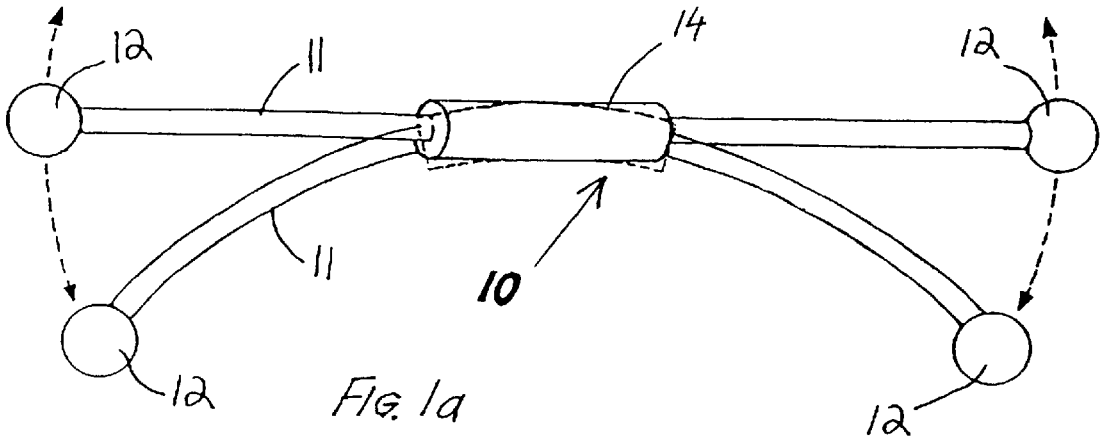
FIG. 1*a* is a front view showing a typical spring bar in accordance with one embodiment of the present invention.
Figure 1B:
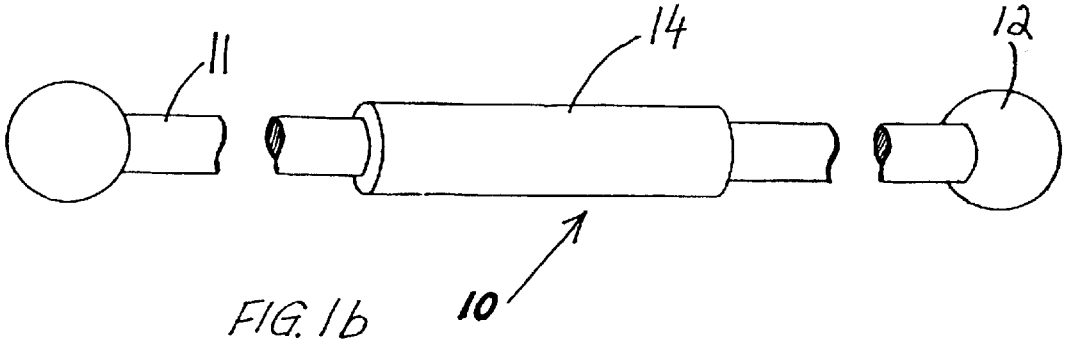
FIG. 1*b* is an enlarged fragmentary perspective view of details of the bar shown in FIG. 1*a;*
Figure 1C:
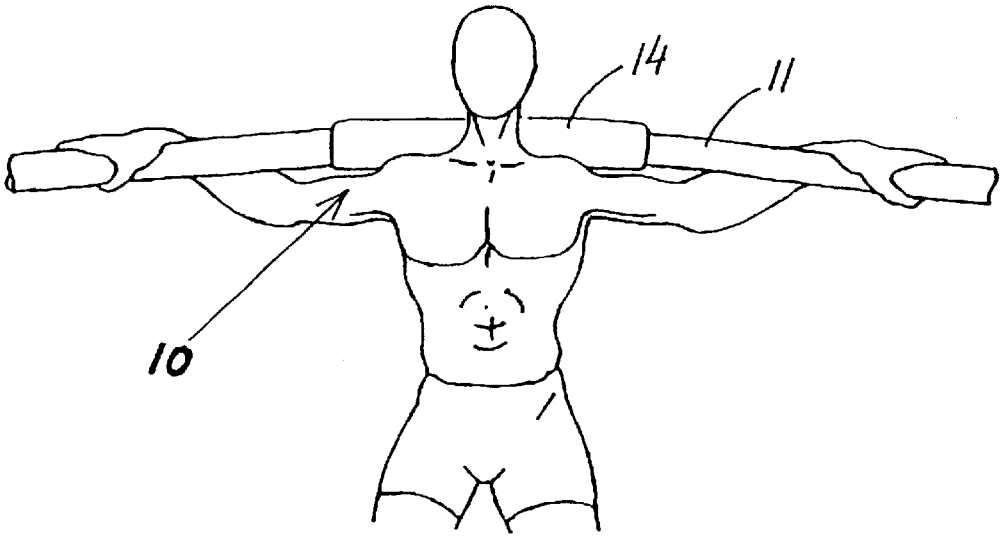
FIG. 1*c* is a fragmentary front elevation showing a typical way of securing the spring bar in FIG. 1*a* on the person's shoulders, in accordance with one embodiment of the present invention.

Referring now to the drawings and in particular to FIG. 1*a* there is shown an exercise device 10 made up of a spring bar 11 and weights 12, one to each end of the bar 11. A protective collar tubing 14 is provided on the central segment of the bar 11. The free ends of the bar 11 are capable of oscillating in opposite directions, thus bending the spring bar into a succession of upward and downward tensioned arcs containing spring energy.

The spring force of the tensioned arc will cause the free ends of the bar to rebound with a force proportional to the arc tension, influenced by the spring characteristics of the bar, the weights at the free ends thereof and the active movements by the person. Since the spring force changes direction with each oscillation, a downward tensioned arc could be used to create an upward oriented spring force, which could vary the bar's pressure on the person and cause an acceleration of the lifting movement.

In a bioresonance mode, i.e. a mode in which the frequency of the spring bar oscillations resonate with the frequency of the person's lifting movements, the rebound of the downward tensioned arc could impart to the free ends of the bar a momentum, enhanced by weights, which in synergy with the person's synchronized upward movement, would further accelerate that movement to the point where a propulsion type lift-off motion can result.

Figure 2A:
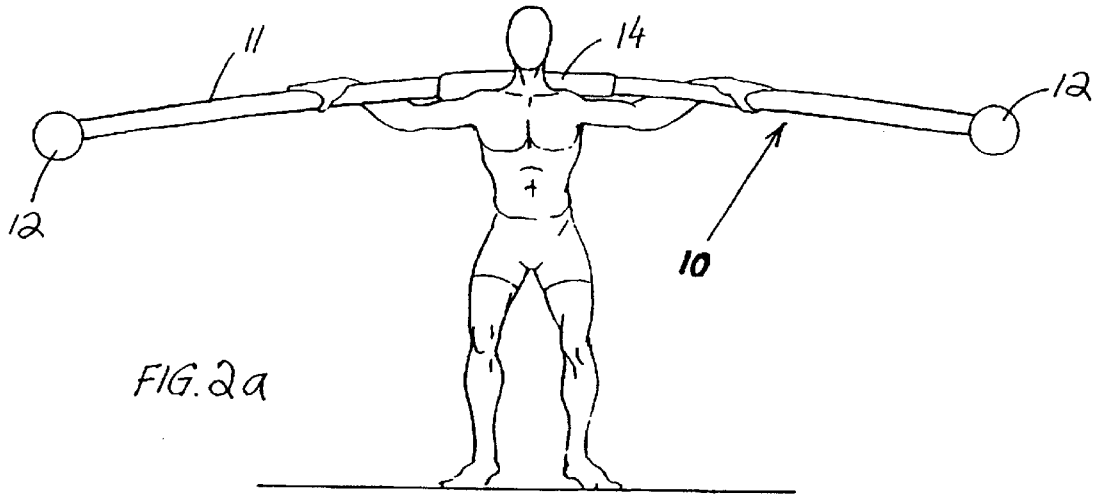
FIGS. 2*a* through 2*h* are front views showing a series of positions of an embodiment of the present invention being used according to the method of the present invention.
Figure 2B:
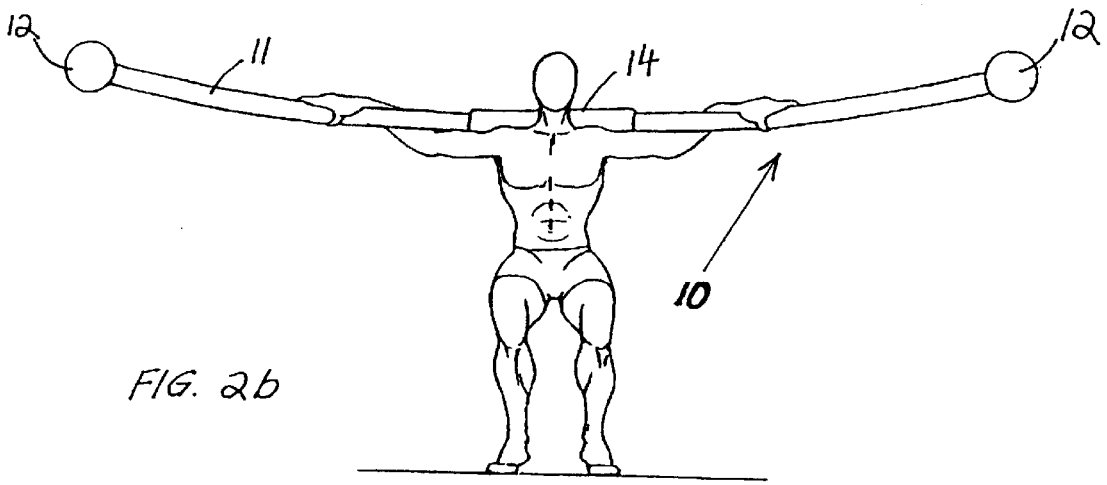
Figure 2C:
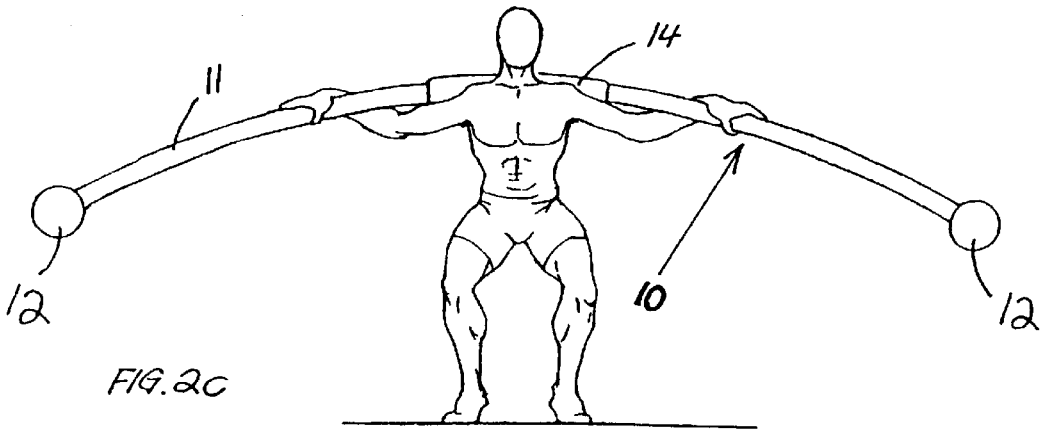

FIGS. 2*a* through 2*h* illustrate a typical exercise using the exercise device 10. From a standing position, the spring bar 11 is secured horizontally, by both arms, on the person's shoulders, as shown in FIG. 2*a*. When the person flexes his knees to execute a squat, this downward motion will tension the spring bar 11, as shown in FIG. 2*b*, causing its free ends to oscillate downwardly. The downward bending of the spring bar 11 will initially act as a shock absorber since the free ends of the spring bar 11 will continue their downward oscillation after the person's squat has ended, as shown in FIG. 2*c*.

Figure 2D:
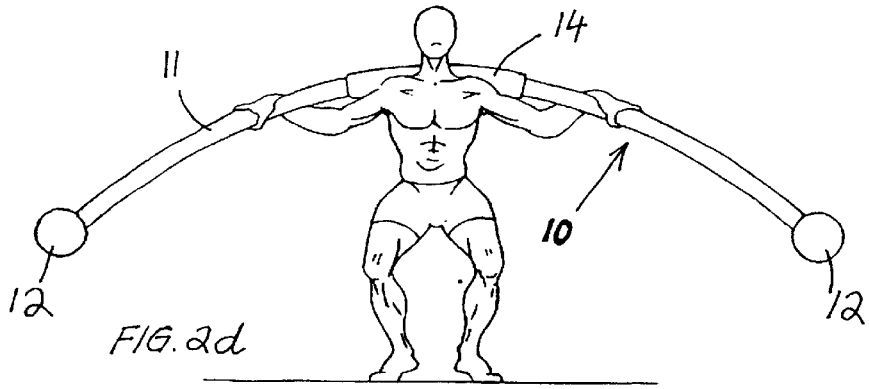

While the free ends of the spring bar 11 continue their downward oscillation, decelerated by the increasing spring forces in the tensioned bar, the person will begin the upward lifting motion, as shown in FIG. 2*d*, causing initially further tensioning of the strained arc. In this phase, the person's lifting motion is opposite to the downward movement of the bar's free ends, and thus the maximum tensioning of the arc takes place. As the tensioned bar 11 is secured to the person's body, the tension in the arc will be transferred gradually to the person's lower body, causing expotonic contractions to take place in the participating muscles.

Figure 2E:
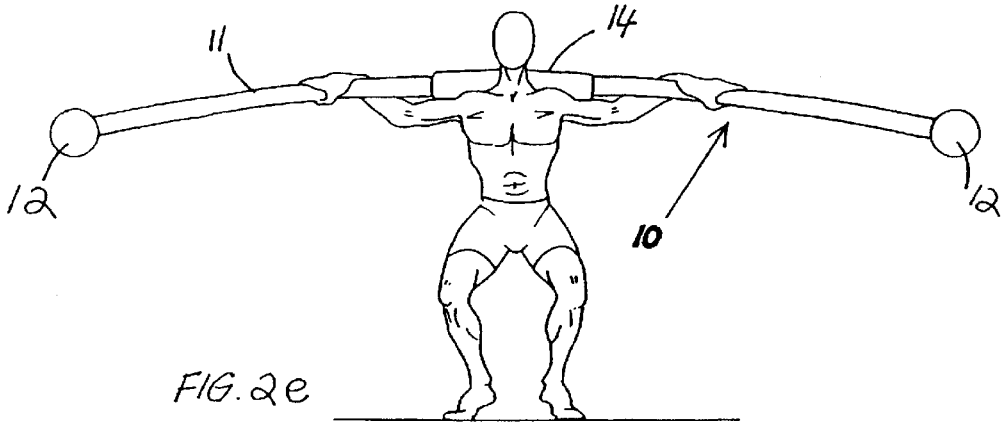

When the spring force created in the tensioned arc exceeds the downward momentum, the upward rebound of the bar's free ends will begin. In the first part of the rebound, the free ends of the bar 11 accelerate upward, causing the middle segment of the bar 11 to exert continuing downward pressure on the person, as shown in FIG. 2*e*.

Figure 2F:
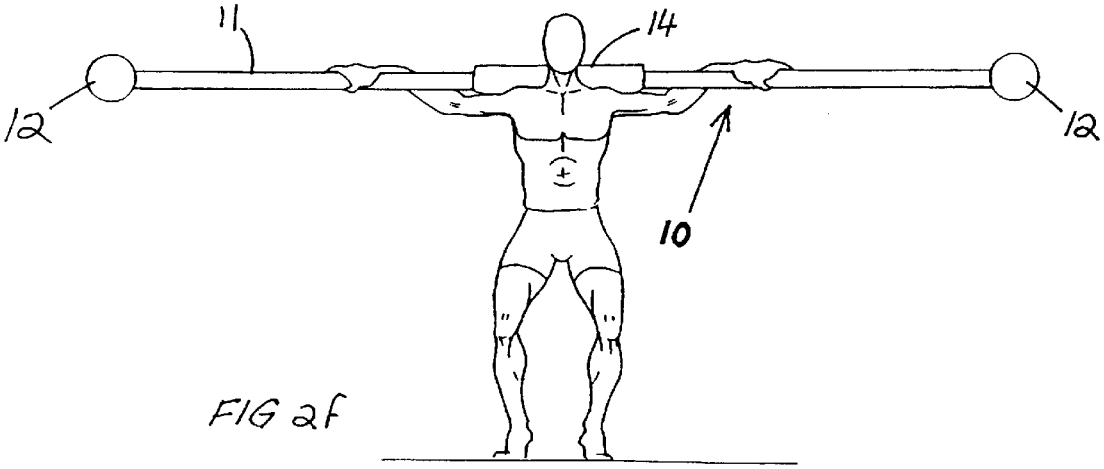

The further upward oscillation will cause a gradual reduction of the bar's downward pressure, creating conditions for accelerating the lifting motion by the person, and this is exemplified in FIG. 2*f*.

Figure 2G:
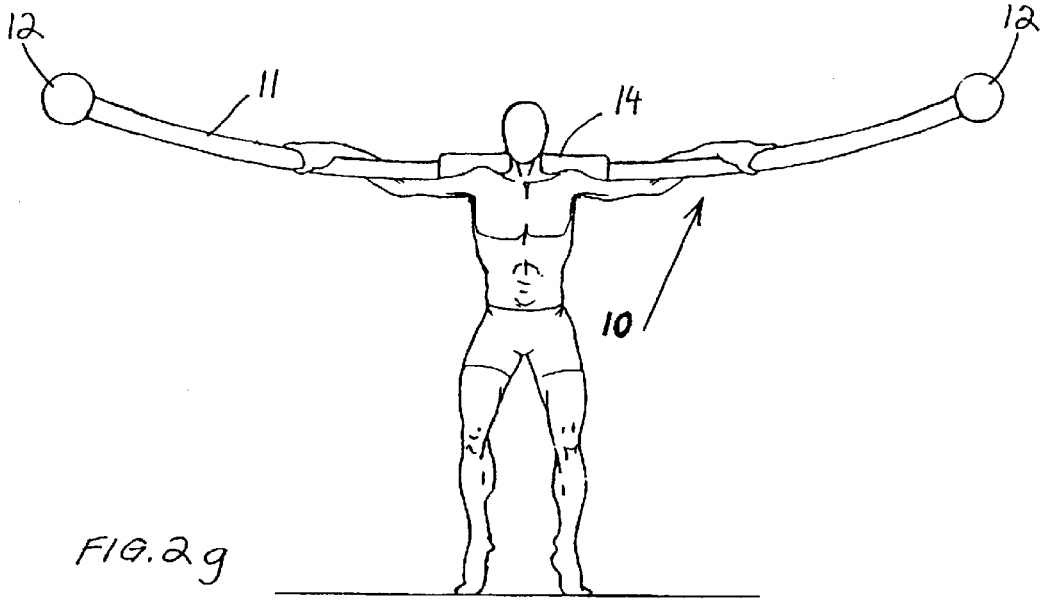

A powerful momentum may cause a continuation of the bar's upward oscillation and the formation of a new arc, oriented upward, as shown in FIG. 2*g*.

Figure 2H:
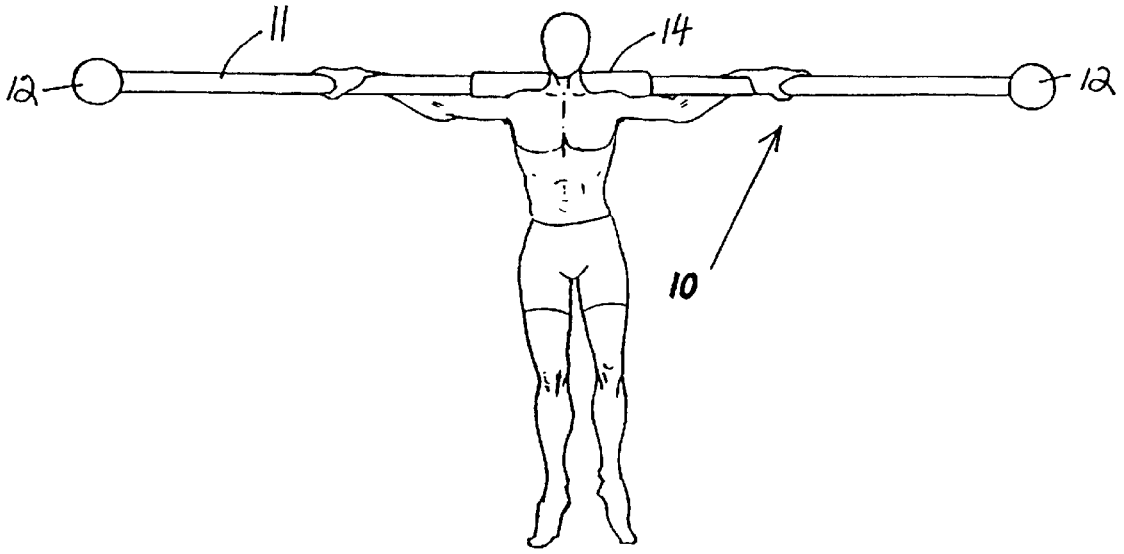

Finally, as shown in FIG. 2*h*, a synergic upward rebound of the middle segment of the spring bar 11 will take place, creating conditions for strong expometric type contractions in the participating muscles and further acceleration of the person's lifting motion.

FIGS. 3*a* through 3*f* show various ways of securing the spring bar to the person's body such as to obtain sufficiently ample oscillations in shorter spring bars typical for home exercises.

Figure 3A:
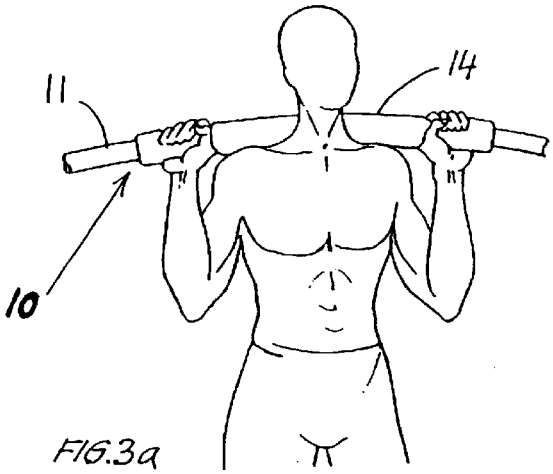
FIGS. 3*a* through 3*f* are fragmentary front views showing other ways of securing the spring bar on the person's body.
Figure 3B:
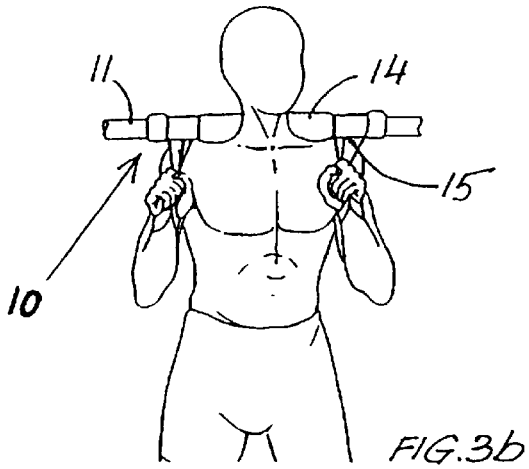

In FIG. 3*a* the spring bar is secured on the person's shoulders by arms, palms oriented upward/forward, similar to the classic holding of a rigid barbell. In FIG. 3*b*, a tight holding behind the person's neck is achieved by way of handles secured to the bar.

Figure 3C:
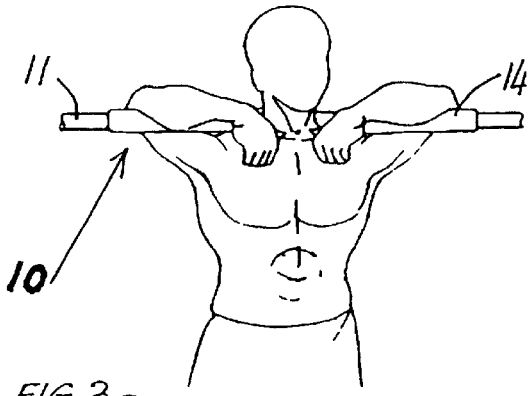
Figure 3D:
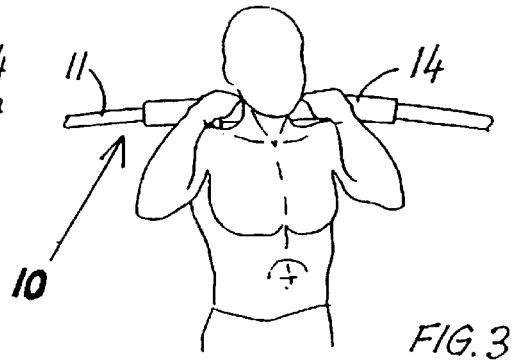

In FIG. 3*c* the bar is "locked" behind the person's neck by his forearms flexed over and downward around the bar's collar tubing. In FIG. 3*d* the "locked" position behind the person's neck is achieved by hands, palms oriented downward/backward.

Figure 3E:
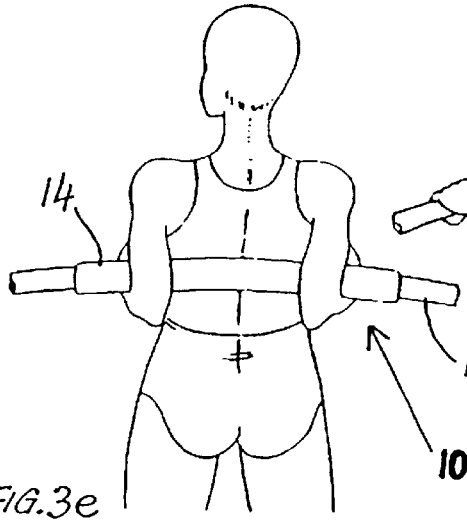
Figure 3F:
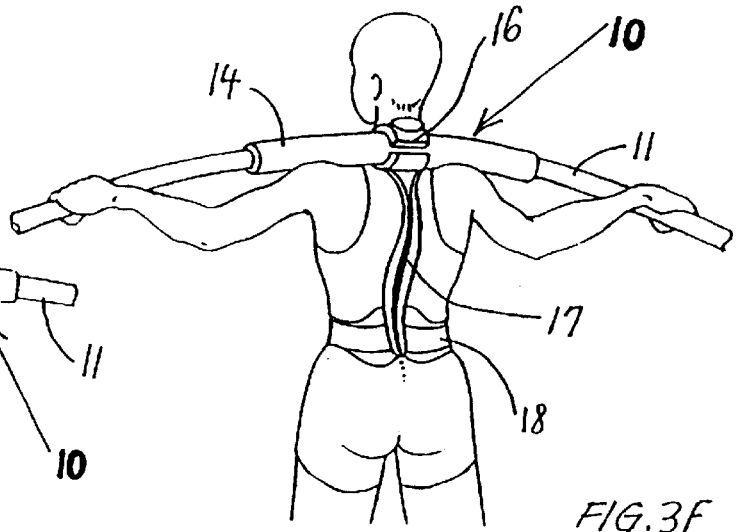

In FIG. 3*e* the bar is "locked" behind the person's waist, by the forearms flexed below and forward around the the bar's collar tubing. In FIG. 3*f* an assisting device of the type "neck-belt-vest" is used to secure the bar on the person's back behind his neck.

FIGS. 4*a* through 4*d* show four embodiments of different types of spring bar constructions. For instance, in FIGS. 4*a* and 4*b* monofilament cables bundled 16 or single 18 and made of different spring materials are extruded in an elastomeric cylinder 17 covered by a protective sleeve or spring tubing 19 to form the body of the bar 11. A central collar tubing 14 is also provided. A fixed weight 12 is mounted to each end of the bar 11.

In the embodiment shown in FIG. 4*c* a spaced coil spring 22 is rolled around a thick multifilament cable 20 to form an elastomeric cylinder inserted into a tube 24 made of spring material to form the body of the spring bar 11.

In the embodiment shown in FIG. 4*d* succession of rigid "vertebrae" 26 made of heavy material and disks 28 made of rubber or other flexible material are threaded on a multifilament cable 20 to form an elastomeric cylinder inserted into a tube 24 made of spring material to form the body of the bar 11.

The weight of the exercise device is relatively heavy since it is meant to develop the strength of the lower body muscles. Different weights, however, will be necessary for the development of different muscles at different velocities. For instance, heavier weights will be necessary for the development of the larger thigh muscles while for the development of the smaller ankle and foot muscles lighter weights may be appropriate.

Figure 5A:
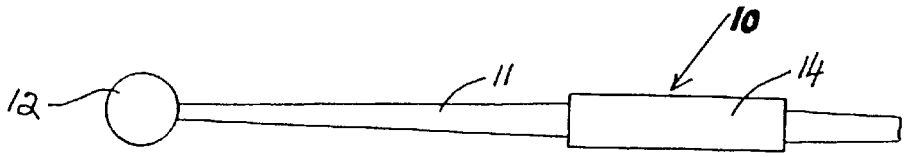
FIGS. 5*a* through 5*c* are fragmentary views of different types of weights used with the spring bar of the present invention.
Figure 5B:
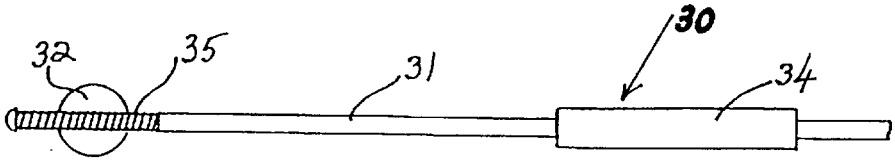
Figure 5C:
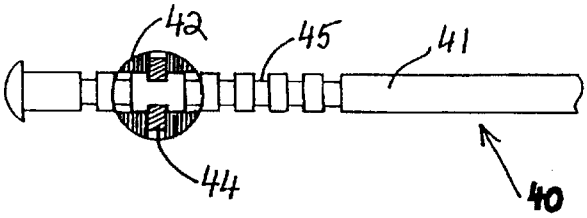

FIGS. 5*b* and 5*c* show examples of exercisers with adjustable weights attached to a spring bar of a constant diameter, compared to an exerciser with fixed weights attached to a spring bar with a variable diameter, shown in FIG. 5*a*.

For example in FIG. 5*b* the exercise device 30 includes a spring rod 31 on which threads 35 have been formed. The end weight 32 is adjustable along a portion of the length of rod 31. FIG. 5*c* illustrates a similar exercise device 40 provided with threads 45 and an end weight 42, secured to the rod 41 by pliers 44.

Figure 6A:
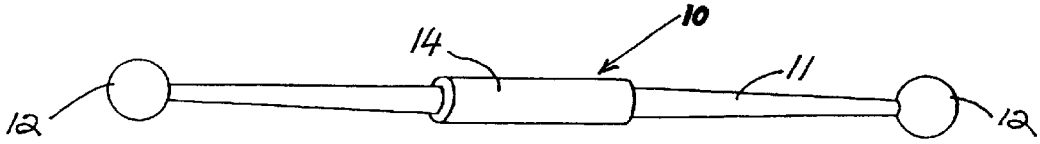
FIGS. 6*a* through 6*c* show different embodiments of the spring bar of the present invention made of one piece or more separable segments.

The exercise device of the present invention could consist of a single compact piece that includes the flexible bar 11 provided with the collar tubing 14 and the fixed end weights 12, as shown in FIG. 6*a*. Alternatively, the exercise device could be made of two or more separable pieces, assembled into one single device only for the purpose of exercising.

Figure 6B:
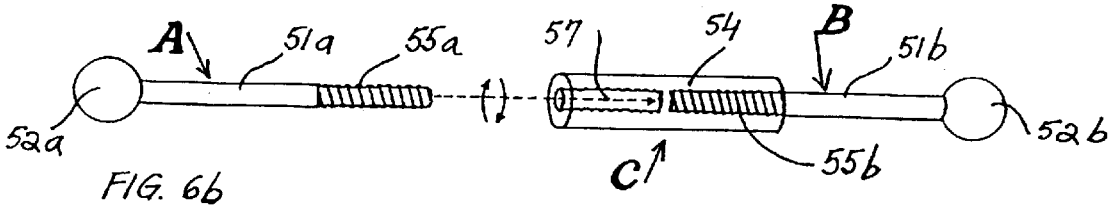

For example, FIG. 6*b* shows an exercise device composed of several separable pieces or segments in which the separable segment A consisting of the spring bar 51*a* and provided with the thread 55*a* and end weight 52*a* is mounted into the central segment C, consisting of a threaded cylinder 57 and covered by the collar tubing 54, and in which the separable segment B, identical with the segment A, has already been mounted. In each of the identical segments A and B the end weights 52*a* and 52*b* could also be separable and connected to the spring bars 51*a* and 51*b*, through threads or other means, for the purpose of exercising.

Figure 6C:
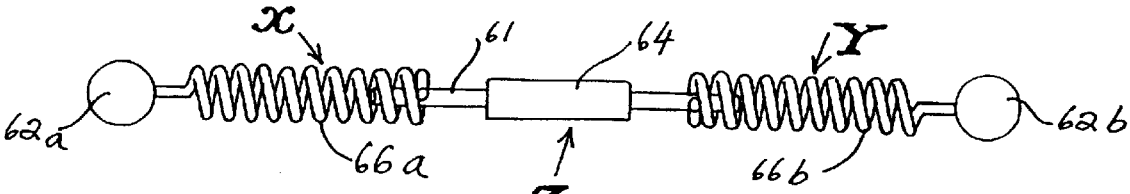

Another example is shown in FIG. 6*c* in which the separable central segment Z is mounted into the separable identical segments X and Y, in which the end weights 62*a* and 62*b* could also be separable.

Figure 7A:
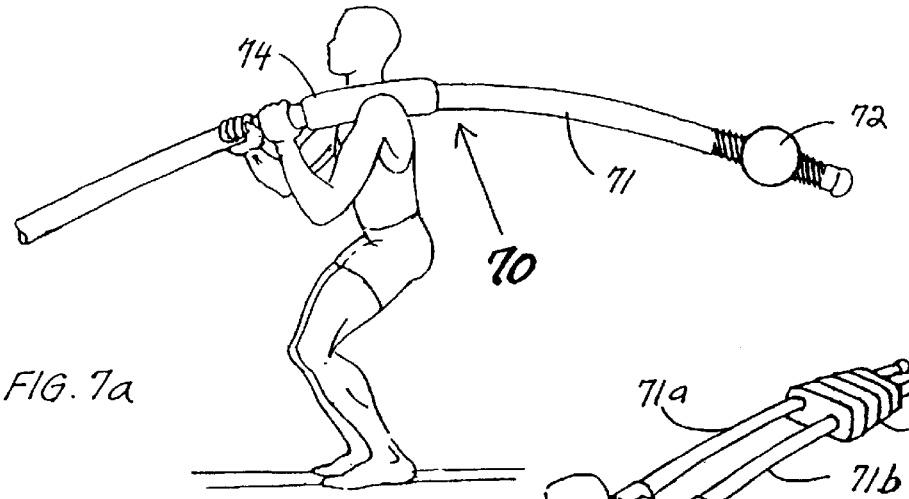
FIGS. 7*a* and 7*b* show another embodiment of the present invention in different operative positions.
Figure 7B:
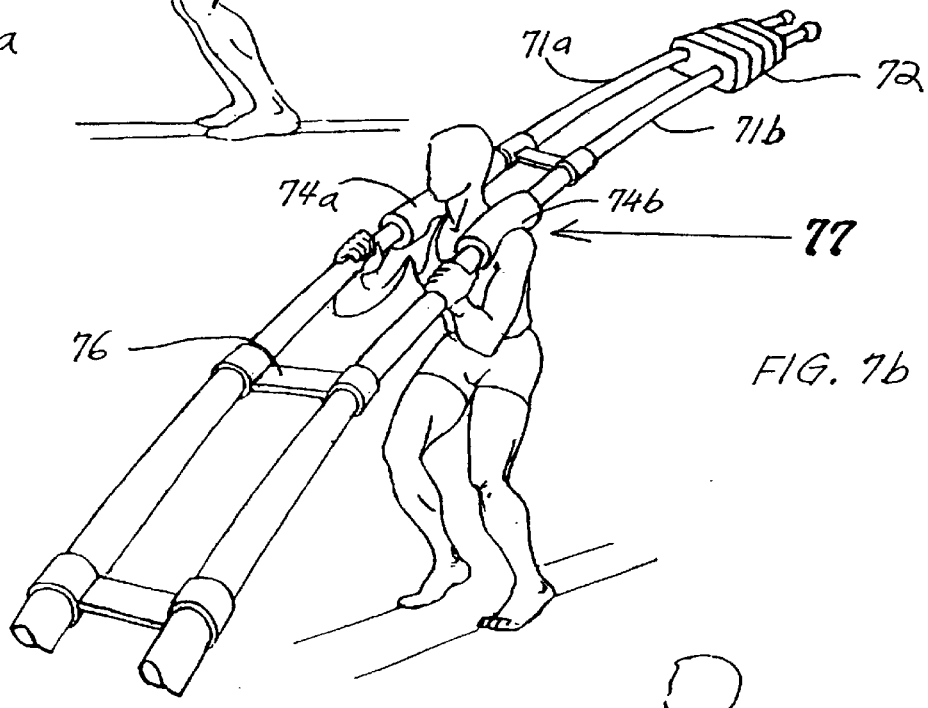

FIGS. 7*a* and 7*b* illustrate another embodiment of the present invention where the exercise devices 70 and 77 consist of a single spring bar 70 or a pair of parallel bars 71*a* and 71*b* connected together by spacer rods 76. End weights 72, fixed or adjustable, are mounted to the only free end of the bar 70 or pairs of bars 71*a* and 71*b*. The other end is secured through a hinge-type mechanism at or above the ground level, allowing for radial-type vertical movements of the exercise devices 70 and 77, supported on the shoulders of the person by means of padded collar tubings 74, and 74*a* and 74*b* respectively.

Figure 8:
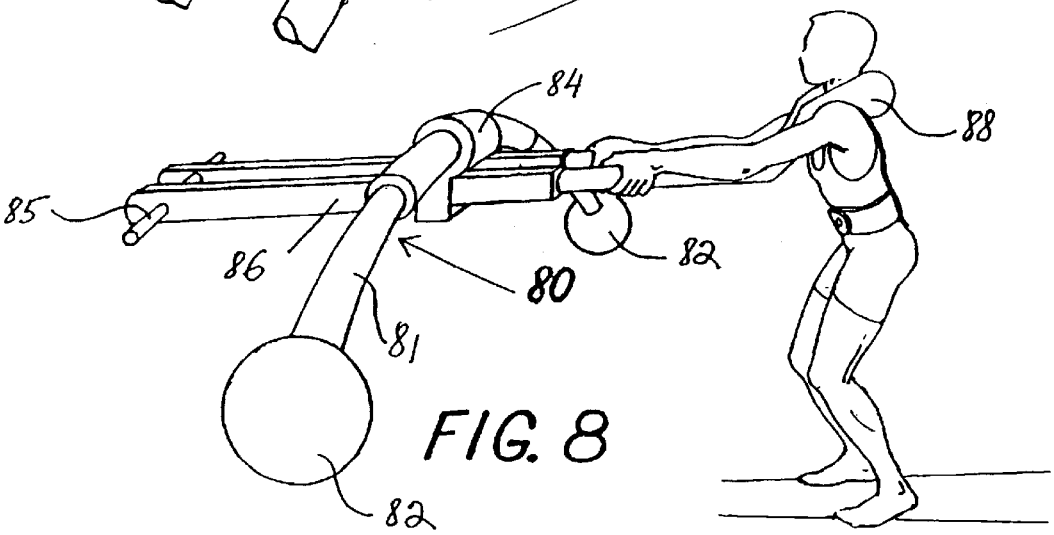
FIG. 8 shows a further embodiment of the present invention.

In another embodiment of the present invention, as shown in FIG. 8, an exercise device 80 is shown which can be utilized for larger weights. In this case the exercise device includes a flexible bar 81 provided with end weights 82 and a sleeve 84 that mounts the bar 81 to a lever 86 pivotally mounted to a supporting frame at pivot 85. A harness 88 would be engaged by the person to raise and lower the lever 86 to which the exercise device 80 would be mounted.

The overall length of the bar is generally a function of the amplitude of oscillations sought to be obtained, which are also influenced by the specific way the spring bar is attached to the person's body. For most applications the bar's length will exceed eight feet such as to obtain ample oscillations of its free ends, capable of being synchronized with the person's lower body movements in a "bioresonance" mode.

As a general rule, the oscillations should be much ampler than simple vibrations since it is the tensioned arc synergy, proportional with the amplitude of its oscillations, that is being sought. There is, however, a large range of the oscillations amplitude that could usefully match an equally large range of the person's lower body motions, depending on what exactly the exercise seeks to develop. For example, ampler oscillations will be needed for the development of the larger thigh muscles, generally engaged in larger ROM's ("range of motion"), while less ample oscillations will be appropriate for the development of the ankle and foot muscles, comparably engaged in reduced ROM's.

Also, probably ampler oscillations will be sought by a high-jumper, basketball or volleyball player and less ample oscillations by a sprint runner, long-jumper, baseball or football player. However, since the exercise device proposed in the present invention addresses the combined motions of the lower body as a whole (feet, legs, thighs), generally, relatively ample oscillations of the spring bar, without active movements by person's arms, will be typical of its use, as opposed to simple vibrations.

In a specific example, an exercise device designed for use by an experienced athlete would include a spring bar of between 8 and 18 feet in length with a diameter of between ½" and 3" and with a weight of between 20 lbs and 200 lbs, generally of the type shown in FIG. 2. The bar may or may not have weights at or toward the ends thereof. Generally, at constant flexibility characteristics, the shorter the length of the bar the more will weights be needed at its ends in order to produce sufficient arc tension and amplitude for the purpose of the exercise.

Another version of the proposed exercise device, useful for training by junior athletes, would be a thinner spring bar slightly longer than 8 ft. provided with fixed or adjustable weights at the ends thereof, so that the total weight would be between 10 and 60 lbs.

Shorter and lighter spring bars will also be useful in home work-outs for general body conditioning, in which sufficient amplitude could be obtained by "locking" the bar's central segment to the person's body by hands, arms, handles or "neck-belt-vest" assisting devices, as shown in FIG. 3. By immobilizing both the middle segment of the spring bar and the person's arms in a tight grip, a better interaction in between the bar's spring energy and the person's lower body movements could be achieved, that will allow for prolonged series of successive expotonic and expometric muscular contractions to be maintained (that is aerobic series of vertical bounds on one or both feet).

We claim:

1. A method of exercising a lower put of the body of a person by performing a cyclical sequence of expotonic and expometric contractions of participating muscles, of the lower part of the body, using a bioresonance apparatus to transfer and store spring energy in said apparatus and said participating muscles, of the lower part of the body, thus enhancing the expotonic contractions of said participating muscles, said method of exercising comprising the steps of:

causing the person to retain said apparatus horizontally across the body of the person;

causing the bioresonance apparatus to move cyclically up and down so that said apparatus oscillates vertically in order to transfer and store spring energy in said apparatus and said participating muscles thus enhancing the expotonic contractions of said participating muscles;

selecting an oscillation frequency of said apparatus according to a bioresonance exercise regimen;

synchronizing, throughout the range of motion of the exercise, the cycles of movement of the body of the person with the cyclical oscillations of said apparatus at the selected bioresonance frequency; whereby the body of the person moves from an erect position to a squat position and from a squat position to an erect position, in phase with the oscillation frequency of said apparatus; and whereby said apparatus is used to enhance the expometric contractions of said participating muscles conducive of an accelerated vertical motion by the person.

2. The method of exercising the lower body of a person as claimed in claim 1 comprising the steps of:

performing a number of expotonic contractions and expometric contractions, as prescribed by the exercise regimen for a specific length of time at said bioresonance frequency;

subjecting successively the participating muscles to an increased tension and an explosive release of said tension, said increased tension being attained by transforming kinetic energy of the bioresonance apparatus into potential energy stored in said apparatus and imparted to said participating muscles, and said explosive release of said tension being attained as the bioresonance apparatus releases the spring tension transforming potential energy stored in the deformation of said apparatus into kinetic energy imparted to said participating muscles, and being thus conducive of an accelerated motion oriented against gravity.

3. The method of exercising the lower body of a person as claimed in claim 2, wherein the bioresonance apparatus comprises at least one elongated spring member of a variable geometry having a length and opposed ends, each of said spring members comprising at least one flexible spring element extending through at least a portion of the length of said spring member.

4. The method of exercising the lower body of a person as claimed in claim 3, in which said at least one spring member extends to less than 8 feet in length and weighs less than 10 lbs. and is used to effect jumps with one or both legs, or is used in walking and running exercises.

5. The method of exercising the lower body of a person as claimed in claim 3, wherein the process of selecting an oscillation frequency of said bioresonance apparatus consists of adjusting the oscillation frequency of said bioresonance apparatus.

6. The method of exercising the lower body of a person as claimed in claim 5, wherein weights are mounted at or spaced away from the ends of at least one of said spring member such that the frequency of oscillation of said bioresonance apparatus is adjusted by securing said weights at different locations along said spring member.

7. The method of exercising the lower body of a person as claimed in claim 5, in which said oscillation frequency of said bioresonance apparatus is adjusted to a low bioresonance frequency such that a slow cyclical oscillatory exercise can be performed according to a muscle building exercise regimen.

8. The method of exercising the lower body of a person as claimed in claim 5, in which said oscillation frequency of said bioresonance apparatus is adjusted to a high bioresonance frequency such that a fast cyclical oscillatory exercise can be performed according to a muscle toning exercise regimen.

9. The method of exercising the lower body of a person as claimed in claim 3, wherein at least one of said spring members is disposed perpendicular to the axis of motion of the body during the exercise.

10. The method of exercising the lower body of a person as claimed in claim 9, wherein said bioresonance apparatus is centered on the shoulders of the person such that said pair of ends of said spring member project a distance on either side of the person.

11. The method of exercising the lower body of a person as claimed in claim 10, wherein said bioresonance apparatus is retained by use of various hand grasping positions.

12. The method of exercising the lower body of a person as claimed in claim 10, wherein said bioresonance apparatus is retained by using handles.

13. The method of exercising the lower body of a person as claimed in claim 9, wherein said bioresonance apparatus is secured to one of the person's front, a side and back of the torso below the person's shoulders.

14. The method of exercising the lower body of a person as claimed in claim 9, wherein said bioresonance apparatus is secured indirectly to the person's body by being attached to a supporting device.

15. The method of exercising the lower body of a person as claimed in claim 14, wherein said bioresonance apparatus is indirectly secured to the person by the use of a collar-vest-belt.

* * * * *

UNITED STATES PATENT AND TRADEMARK OFFICE

CERTIFICATE OF CORRECTION

PATENT NO. : 6,280,364 B1
DATED : August 28, 2001
INVENTOR(S) : Titus Deac et al.

It is certified that error appears in the above-identified patent and that said Letters Patent is hereby corrected as shown below:

Column 7,
Line 5, "put" should be -- part --.

Signed and Sealed this

Thirtieth Day of August, 2005

JON W. DUDAS
*Director of the United States Patent and Trademark Office*